US011753211B2

(12) United States Patent
Lee

(10) Patent No.: US 11,753,211 B2
(45) Date of Patent: Sep. 12, 2023

(54) SAFE GUARD ZIPPER BAG

(71) Applicant: STANDPACK CO., LTD., Yongin-si (KR)

(72) Inventor: Jong-Soon Lee, Anyang-si (KR)

(73) Assignee: STANDPACK CO., LTD.

( * ) Notice: Subject to any disclaimer, the term of this patent is extended or adjusted under 35 U.S.C. 154(b) by 0 days.

(21) Appl. No.: 16/965,089

(22) PCT Filed: Feb. 20, 2019

(86) PCT No.: PCT/KR2019/002055
§ 371 (c)(1),
(2) Date: Jul. 27, 2020

(87) PCT Pub. No.: WO2019/172558
PCT Pub. Date: Sep. 12, 2019

(65) Prior Publication Data

US 2021/0114777 A1 Apr. 22, 2021

(30) Foreign Application Priority Data

Mar. 5, 2018 (KR) ..... 10-2018-0025588

(51) Int. Cl.
*B65D 33/25* (2006.01)

(52) U.S. Cl.
CPC ..... *B65D 33/2508* (2013.01)

(58) Field of Classification Search
CPC . B65D 33/25; B65D 33/2508; B65D 2215/08
(Continued)

(56) References Cited

U.S. PATENT DOCUMENTS 9,624,003 B1 4/2017 Tseng et al.
2007/0183692 A1* 8/2007 Pawloski ..... B65D 33/2566 383/63

(Continued)

FOREIGN PATENT DOCUMENTS

DE 9312370 U1 8/1994
EP 3693288 A1 * 8/2020 ..... B65D 33/2541

(Continued)

OTHER PUBLICATIONS

International Search Report from PCT/KR2019/002055, dated Jun. 20, 2019, pp. 1-4, including English translation.

(Continued)

*Primary Examiner* — Jes F Pascua
(74) *Attorney, Agent, or Firm* — The Belles Group, P.C.

(57) ABSTRACT

The present invention relates to a safeguard zipper bag, and more particularly, to a safeguard zipper bag that has a dual opening part in order to disperse force applied to the zipper bag, such that the safeguard zipper bag is difficult to open by outer opening parts and easy to open by inner opening parts, and the safety of the safeguard zipper bag is improved. A safeguard zipper bag according to the present invention may include: an envelope in the form of a bag; and a male zipper part and a female zipper part attached to inner surfaces of the envelope, in which one portion or the other portion of at least one of the male zipper part and the female zipper part, which is spaced apart, at a predetermined interval, from a portion where the male zipper part and the female zipper part are coupled by male/female engagement, is attached to the inner surface of the envelope. In this manner, it is possible to provide a low-cost, high-efficiency, and safe zipper bag which is not easy to primarily open due to dispersion of force without forming an additional accessory and increasing costs.

5 Claims, 3 Drawing Sheets

(58) Field of Classification Search
USPC ..... 383/63
See application file for complete search history.

(56) References Cited

U.S. PATENT DOCUMENTS

| | | | | |
|---|---|---|---|---|
| 2014/0161374 | A1 | 6/2014 | Rojas et al. | |
| 2014/0270585 | A1* | 9/2014 | Heckman | B65D 33/2508 383/63 |
| 2016/0122087 | A1* | 5/2016 | Takigawa | B65D 33/2508 383/63 |
| 2017/0152085 | A1* | 6/2017 | Septien Rojas | B65D 33/2541 |
| 2017/0217650 | A1* | 8/2017 | Steele | B65D 33/2591 |
| 2018/0362220 | A1* | 12/2018 | Wang | B65B 61/188 |
| 2020/0198842 | A1* | 6/2020 | Hansen | B65D 33/25 |
| 2021/0114782 | A1* | 4/2021 | Shen | B65D 50/046 |

FOREIGN PATENT DOCUMENTS

| | | | | |
|---|---|---|---|---|
| FR | 2942209 | B1 * | 5/2016 | B65D 33/2533 |
| JP | 3052894 | U | 7/1998 | |
| JP | 2015-217980 | A | 12/2015 | |
| KR | 20-0440413 | Y1 | 6/2008 | |
| KR | 10-0967524 | B1 | 7/2010 | |
| KR | 10-2013-0004981 | A | 1/2013 | |
| WO | WO-2017087359 | A1 * | 5/2017 | B65D 33/2541 |
| WO | WO-2019016553 | A1 * | 1/2019 | B65D 33/2508 |

OTHER PUBLICATIONS

Office Action issued by KIPO for corresponding priority application No. KR 10-2018-0025588 dated Mar. 4, 2019, pp. 1-5. (No English Translation available).

* cited by examiner

[Figure 1]
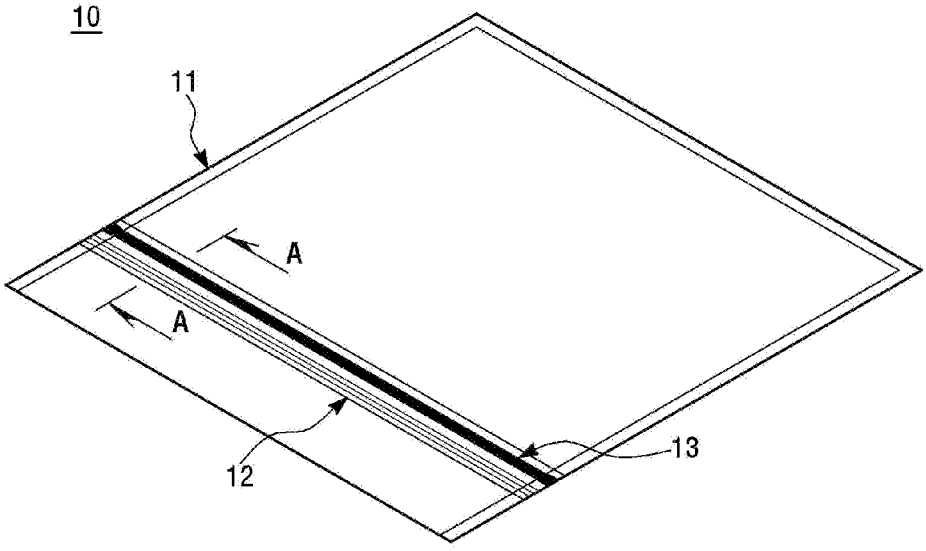
[Figure 2]
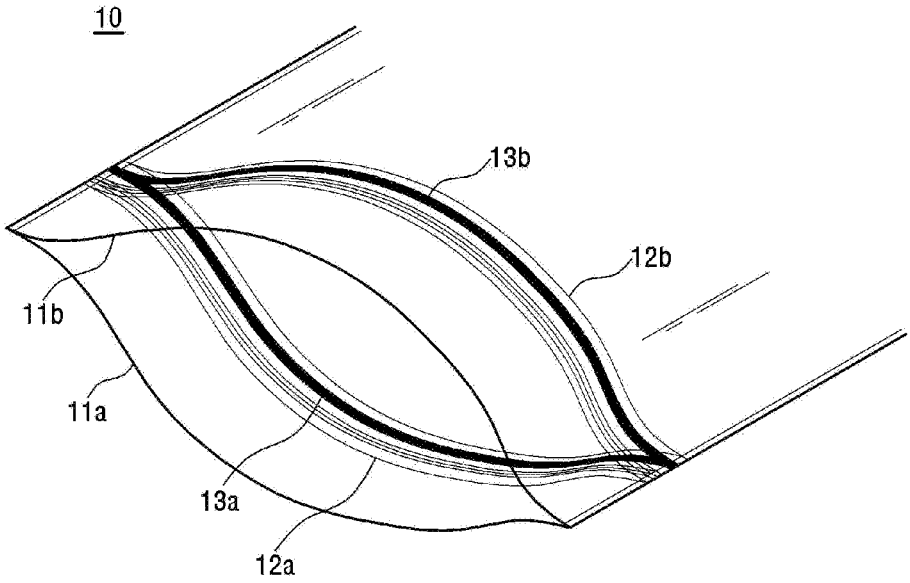

[Figure 3]
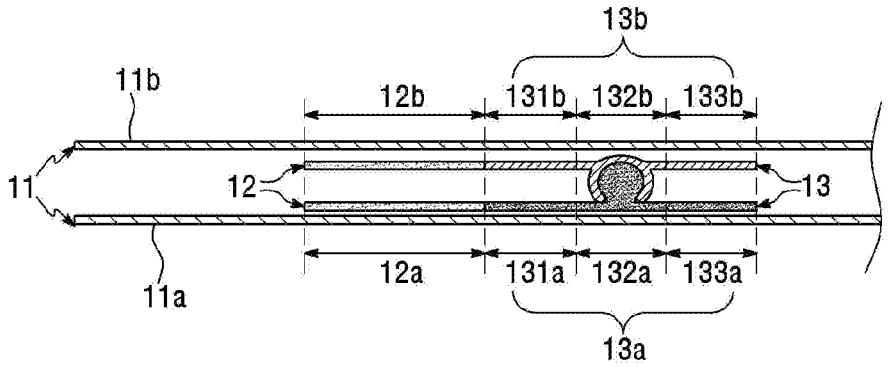
[Figure 4]
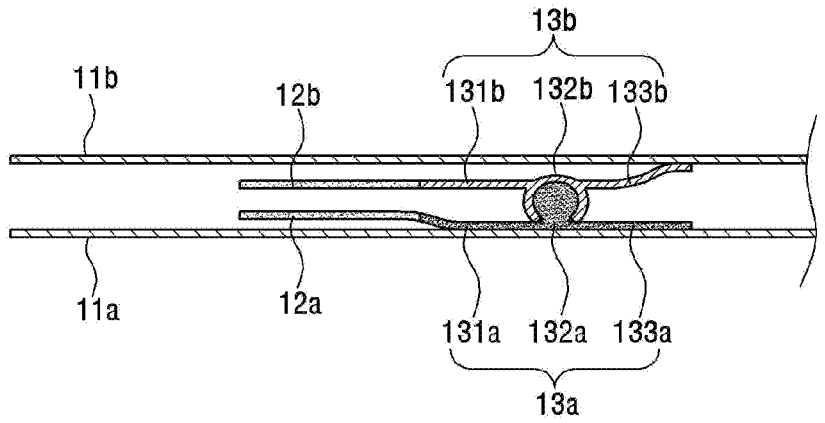
[Figure 5]
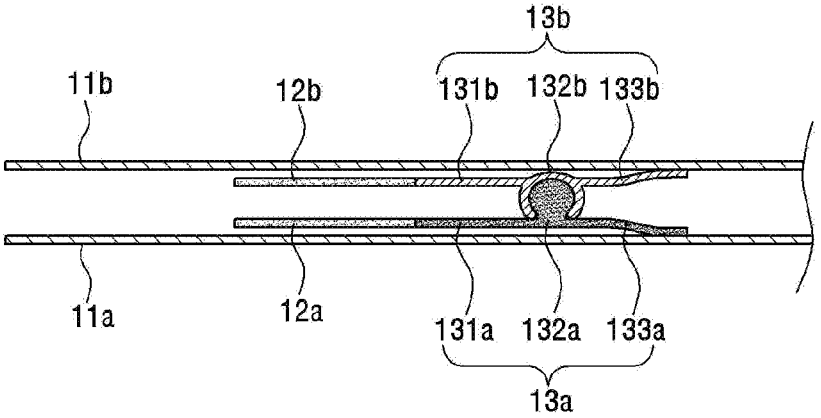

[Figure 6]
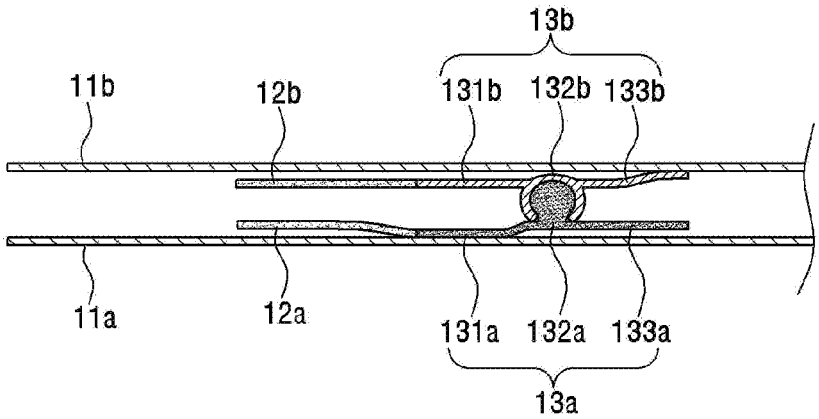
[Figure 7]
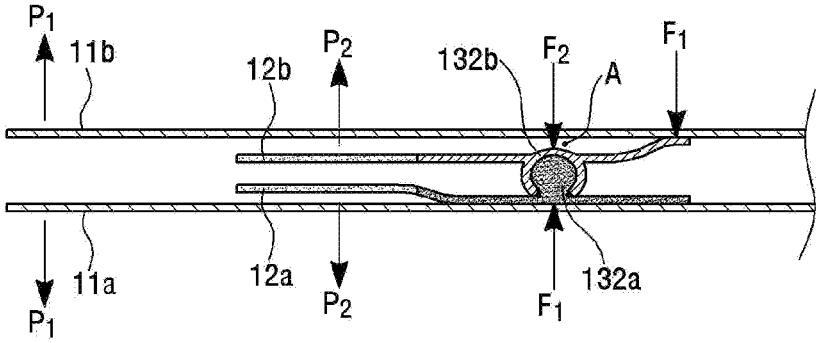
[Figure 8]
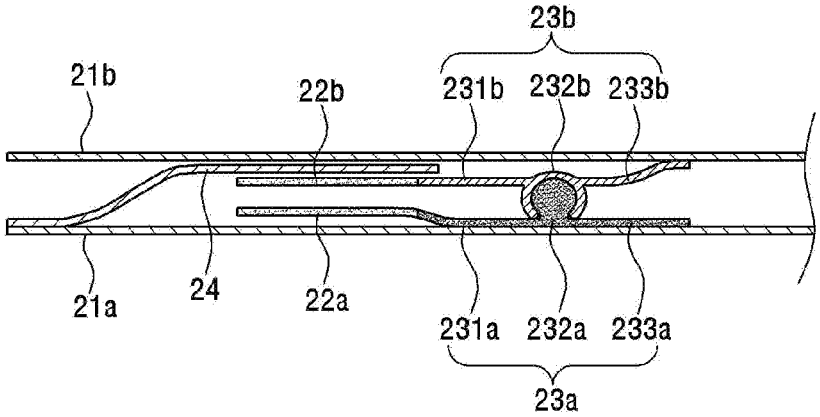

SAFE GUARD ZIPPER BAG

CROSS-REFERENCE TO RELATED PATENT APPLICATIONS

The present application is a U.S. national stage application under 35 U.S.C. § 371 of PCT Application No. PCT/KR2019/002055, filed Feb. 20, 2019, which claims priority to Korean Patent Application No. 10-2018-0025588, filed Mar. 5, 2018. The disclosures of the aforementioned priority applications are incorporated herein by reference in their entireties.

TECHNICAL FIELD

The present invention relates to a safeguard zipper bag, and more particularly, to a safeguard zipper bag that has a dual opening part in order to disperse force applied to the zipper bag, such that the safeguard zipper bag is difficult to open by outer opening parts and easy to open by inner opening parts, and the safety of the safeguard zipper bag is improved.

BACKGROUND ART

In general, a zipper bag refers to a packaging bag provided with a zipper including female and male coupling portions at an inlet of the zipper bag. The zipper bag is a daily commodity configured to effectively protect an article from an external environment by locking the zipper and sealing the zipper bag in a state in which the article is stored in the zipper bag.

The zipper bag is particularly useful to store food and drink that require freshness and cleanliness or to store liquid materials that are prone to leaking. Further, a self-standable pouch or a flat bag has been well known which has a zipper used to open or close an opening part.

The zipper mounted on the bag includes a male track (male zipper part) and a female track (female zipper part) that may be coupled to each other.

The male track and the female track are formed on inner surfaces of a pair of facing members of a main body part of the bag so as to face each other, and the male track and the female track extend in a transverse direction of the main body part of the bag. Because the zipper generally extends over the entire transverse direction of the main body part of the bag, the main body part of the bag is opened over the entire region in the transverse direction by unlocking the zipper.

However, depending on types of contents to be stored, it is necessary to make it difficult to easily open the zipper bag from the outside. Particularly, there is a safety problem in a case in which items that should not be touched by children or infants are contained in the zipper bag.

In view of this, a zipper bag in which zippers are arranged in a double or triple layer has been proposed, but such a zipper bag also has a structure inevitably opened by a slight force. Recently, a zipper bag, which has an added safety locking device in order to improve safety, has been released, but such a zipper bag is inconvenient to use and has a problem of increasing cost.

Korean Utility Model Registration No. 20-0440413 discloses a dual zipper bag, but such a dual zipper bag is made by focusing on efficiency of a storage space rather than safety.

DISCLOSURE

Technical Problem

The present invention has been made in an effort to solve the above-mentioned problems in the related art, and a technical object to be achieved by the present invention is to provide a zipper bag that is difficult to easily open.

In particular, another object is to provide a zipper bag that may prevent an infant or a child from opening the zipper bag and taking out contents unintentionally.

In addition, still another object is to provide a low-cost, high-efficiency, and safe zipper bag that may have high safety without forming an additional accessory or increasing costs, may be opened in consideration of dispersion of force, and may meet the unit price required to manufacture a vinyl zipper bag in the related art.

Technical Solution

In order to achieve the above-mentioned objects, a safeguard zipper bag according to the present invention may include: an envelope in the form of a bag; and a male zipper part and a female zipper part attached to inner surfaces of the envelope, in which one portion or the other portion of at least one of the male zipper part and the female zipper part, which is spaced apart, at a predetermined interval, from a portion where the male zipper part and the female zipper part are coupled by male/female engagement, is attached to the inner surface of the envelope.

In addition, a safeguard zipper bag according to the present invention may include: an envelope in the form of a bag; and a male zipper part and a female zipper part attached to inner surfaces of the envelope, in which the male zipper part includes a first horizontal extension portion, a protrusion portion, and a second horizontal extension portion, in which the female zipper part includes a first horizontal extension portion, a groove portion, and a second horizontal extension portion, in which one or more of the first horizontal extension portion, the protrusion portion, and the second horizontal extension portion of the male zipper part are attached to one surface in the envelope, in which one or more of the first horizontal extension portion, the groove portion, and the second horizontal extension portion of the female zipper part are attached to the other surface in the envelope, and in which any one of the protrusion portion and the groove portion is attached to the inner surface of the envelope or neither the protrusion portion nor the groove portion is attached to the inner surface of the envelope.

In this case, inner opening parts may extend at tips of the male zipper part and the female zipper part, and the tips are adjacent to opening parts.

In this case, the inner opening part may have the same width as the envelope, and both ends of the inner opening part may be attached to the envelope.

In this case, when an outer opening part is defined from an opening tip of the envelope to the zipper bag, the inner opening part may have a smaller depth than the outer opening part.

In this case, when an outer opening part is defined from an opening tip of the envelope to the zipper bag, a tip of the inner opening part may be formed at a position recessed from a tip of the outer opening part in a direction of the zipper.

In this case, the first horizontal extension portion, the protrusion portion, and the second horizontal extension portion of the male zipper part may be attached to one surface in the envelope, and the second horizontal extension portion of the female zipper part may be attached to the other surface in the envelope.

In this case, the second horizontal extension portion of the male zipper part may be attached to one surface in the envelope, and the first horizontal extension portion, the groove portion, and the second horizontal extension portion of the female zipper part may be attached to the other surface of the envelope.

In this case, the safeguard zipper bag may further include a dual cover extending from any one of the opening parts of the envelope and bent inward.

Advantageous Effects

According to the configuration of the present invention, it is possible to particularly provide the zipper bag that may prevent an infant or a child from opening the zipper bag and taking out the contents.

In addition, it is possible to provide the low-cost, high-efficiency, and safe zipper bag that may be opened in consideration of dispersion of force without forming an additional accessory or increasing costs and may meet the unit price required to manufacture a vinyl zipper bag in the related art.

DESCRIPTION OF DRAWINGS

FIG. 1 is a perspective view illustrating a safeguard zipper bag according to an exemplary embodiment of the present invention.

FIG. 2 is a view illustrating a state in which opening parts of the safeguard zipper bag according to the exemplary embodiment of the present invention are opened.

FIG. 3 is a cross-sectional view taken along line A-A in FIG. 1 for making a definition for respective positions.

FIG. 4 is a cross-sectional view taken along line A-A in FIG. 1 according to a first exemplary embodiment.

FIG. 5 is a cross-sectional view taken along line A-A in FIG. 1 according to a second exemplary embodiment.

FIG. 6 is a cross-sectional view taken along line A-A in FIG. 1 according to a third exemplary embodiment.

FIG. 7 is a view for explaining a portion for receiving force and a mechanism for dispersing force according to the first exemplary embodiment of the present invention.

FIG. 8 is a cross-sectional view of a safeguard zipper bag according to another exemplary embodiment of the present invention.

DESCRIPTION OF MAIN REFERENCE NUMERALS OF DRAWINGS

10: Zipper bag
11: Envelope
11*a*: First outer opening part
11*b*: Second outer opening part
12: Inner opening part
12*a*: First inner opening part
12*b*: Second inner opening part
13: Zipper
13*a*: Male zipper part
13*b*: Female zipper part
131*a*, 131*b*: First horizontal extension portion
132*a*: Protrusion portion
132*b*: Groove portion
133*a*, 133*b*: Second horizontal extension portion

BEST MODE

Hereinafter, a structure and an operational effect of a safeguard zipper bag according to the present invention will be described with reference to the accompanying drawings.

The detailed description of specific exemplary embodiments illustrated in the accompanying drawings will be read in connection with the accompanying drawings, and the drawings are regarded as a part of the description of the entire invention. The description of directionality or orientation is merely for convenience of description and is not intended to limit the scope of the present invention in any way.

Specifically, the terms "down, up, horizontal, vertical, upper, lower, upward, downward, above, below, etc.", which indicate positions, or derivatives thereof (e.g., "horizontally, downwardly, upwardly, etc.") should be understood with reference to all the drawings and the related descriptions being described. In particular, since these relative words are merely for convenience of explanation, it is not necessary to configure or operate the device of the present invention in a specific direction.

In addition, unless otherwise stated, the terms "mounted, attached, connected, coupled, interconnected, etc.", which indicate coupling relationships between components, may mean that the individual components are directly or indirectly attached, connected, or fixed, and these terms should be understood as the terms including not only a state in which the components are movably attached, connected, or fixed, but also a state in which the components cannot be moved.

In denoting reference numerals to constituent elements of the respective drawings, it should be noted that the same constituent elements will be designated by the same reference numerals, if possible, even though the constituent elements are illustrated in different drawings. In addition, in the description of the present invention, the specific descriptions of publicly known related configurations or functions will be omitted when it is determined that the specific descriptions may obscure the subject matter of the present invention.

FIG. 1 is a perspective view illustrating a safeguard zipper bag according to an exemplary embodiment of the present invention, and FIG. 2 is a view illustrating a state in which opening parts of the safeguard zipper bag according to the exemplary embodiment of the present invention are opened.

Vinyl plastic may be generally used as a material for a zipper bag, and the material of vinyl plastic may be slightly thick and tough in order to form a somewhat bulky zipper on an opening part of the bag.

The term "vinyl" used in the present invention is not a technical name, and generally refers to a film made of synthetic resin in the general sense on the market. The term "vinyl" may be used to generally mean the vinyl for vinyl zipper bags made of not only vinyl resin having a vinyl group, but also a synthetic resin film product such as a polyethylene film product which does not have a vinyl group but is transparent and transmits sunlight like a vinyl product used for vinyl bags, vinyl houses, and the like available on the market.

A zipper bag 10 according to the present invention may include an envelope 11 configured to define an external shape in the form of a bag, a zipper 13 spaced apart from an opening part at a predetermined distance and attached to both sides of inner surfaces of the envelope 11, and an inner opening part 12 extending from the zipper 13 to the opening part.

The opening part of the zipper bag 10 may include a line of male zipper part having a protrusion, and a female zipper part have a line of groove for receiving the protrusion when locked.

As necessary, in order to improve sealability of the bag, two lines of male zipper parts and two lines of female zipper parts, that is, two pairs of zippers may be provided, and two or more pairs of zippers may be provided.

The safeguard zipper bag 10 according to the present invention may include the envelope 11, the inner opening part 12, and the zipper 13. Further, the envelope 11 may be made by joining two vinyl sheets at three sides thereof by ultrasonic welding so that one side thereof may be opened.

The opening part of the envelope 11 may be divided into a first outer opening part 11*a* and a second outer opening part 11*b*.

In addition, in the envelope 11, a male zipper part 13*a* may be attached to the first outer opening part 11*a*, a female zipper part 13*b* may be attached to the second outer opening part 11*b*, and as necessary, and the male zipper part and the female zipper part may be attached vice versa.

A first inner opening part 12*a* may be formed to extend from a tip portion of the male zipper part 13*a* to the opening part, and a second inner opening part 12*b* may be formed to extend from a tip portion of the female zipper part 13*b* to the opening part.

The zipper bag 10 according to the present invention is technically characterized in that the opening parts are separately formed inside and outside the zipper bag and a method of attaching the zipper 13 is different from that in the related art. This will be described below with reference to FIGS. 3 to 7.

The first and second outer opening parts 11*a* and 11*b* are positioned at an outermost side in order to secure safety and characterized in that the zipper 13 is not easily unlocked even though the first and second outer opening parts 11*a* and 11*b* are pulled outward toward both sides by applying force. In order to unlock the zipper 13, the first and second inner opening parts 12*a* and 12*b* positioned inside the zipper bag need to be pulled outward toward both sides by applying force in order to easily unlock the zipper 13.

Therefore, the first and second outer opening parts 11*a* and 11*b* are opening parts for safety that serve as formal opening parts that prevent the zipper from being easily unlocked, and the first and second inner opening parts 12*a* and 12*b* positioned inside the zipper bag play the basic role of actually unlocking the zipper.

This characteristic is based on preventing a user from easily opening the zipper bag, and it is particularly meaningful to prevent a child or an infant from easily opening the zipper bag.

FIG. 3 is a cross-sectional view taken along line A-A in FIG. 1 for making a definition for respective positions.

As illustrated in FIG. 3, a cross section taken along line A-A in FIG. 1 is as illustrated in FIG. 3, in which attached portions are omitted to define respective regions first.

Referring to the cross section, the envelope 11, the inner opening part 12, and the zipper 13 are formed at illustrated positions.

The first and second outer opening parts 11*a* and 11*b* are positioned close to the opening part of the zipper bag and may be defined as a distance from a tip of the envelope to a tip of the inner opening part 12.

The first and second inner opening parts 12*a* and 12*b* may be defined as a distance from a tip of the inner opening part 12 to a tip of first horizontal extension portions 131*a* and 131*b* of the zipper 13.

The zipper 13 may include the male zipper part 13*a* and the female zipper part 13*b*. The male zipper part 13*a* may include a protrusion portion 132*a* at a center thereof, the first horizontal extension portion 131*a* horizontally extending to the left based on the protrusion portion 132*a*, and a second horizontal extension portion 133*a* horizontally extending to the right. The female zipper part 13*b* may include a groove portion 132*b* at a center thereof, the first horizontal extension portion 131*b* horizontally extending to the left based on the groove portion 132*b*, and a second horizontal extension portion 133*b* horizontally extending to the right.

In general, in the zipper bag, the male zipper part 13*a* and the female zipper part 13*b* are attached to the inner surfaces of the envelope 11. Force is applied to the attached portions when both sides of the first and second outer opening parts 11*a* and 11*b* of the envelope 11 are pulled outward in opposite directions, such that the zipper bag may be easily opened while overcoming coupling force between the protrusion portion 132*a* and the groove portion 132*b*. However, the present invention proposes the zipper bag that allows the concentration of force to be dispersed and converted, thereby making it difficult to easily open the zipper bag.

FIG. 4 is a cross-sectional view taken along line A-A in FIG. 1 according to a first exemplary embodiment.

According to the first exemplary embodiment of the present invention illustrated in FIG. 4, the male zipper part 13*a* and the female zipper part 13*b* may be attached to both inner surfaces of the envelope 11, respectively.

In this case, the first and second inner opening parts 12*a* and 12*b*, which extend to the opening part, are formed at the tip of the male zipper part 13*a* and the tip of the female zipper part 13*b*, respectively.

The first and second inner opening parts 12*a* and 12*b* are not attached to the inner surfaces of the envelope 11. The first horizontal blade portion 131*a*, the protrusion portion 132*a*, and the second horizontal blade portion 133*a* of the male zipper part 13*a* are attached to the inner surface of the envelope 11. Only a part of the second horizontal blade portion 133*b* of the female zipper part 13*b* is attached to the inner surface of the envelope 11.

The first exemplary embodiment of the present invention has the envelope 11 in the form of a bag, the male zipper part 13*a* and the female zipper part 13*b* are attached to the inner surfaces of the envelope 11, and the upper and lower portions of the male zipper part 13*a* and the lower portion of the female zipper part 13*b* are attached to the inner surfaces of the envelope, among the upper or lower portions of at least one of the male zipper part 13*a* and the female zipper part 13*b*, which is spaced apart from the portions (the protrusion portion 132*a* and the groove portion 132*b*) where the male zipper part 13*a* and the female zipper part 13*b* are coupled by male/female engagement.

In general, the male zipper part and the female zipper part of the zipper are coupled by means of the protrusion and the groove, and the coupling force between the protrusion and the groove is eliminated when opening the zipper bag. In this case, when the opening parts are pulled outward toward both sides in the state in which the surface of the protrusion and the surface of the groove are attached to each other, force is applied to the attached surfaces, such that the coupling force of the zipper is easily eliminated.

By reversely using this principle, a surface of any one of the male zipper part and the female zipper part is not attached, and thus the surface cannot receive the force, such that a structure in which the zipper is not easily unlocked may be implemented. Therefore, it is possible to implement the simple and safe zipper bag by using this principle.

FIG. 5 is a cross-sectional view taken along line A-A in FIG. 1 according to a second exemplary embodiment.

According to the second exemplary embodiment of the present invention illustrated in FIG. 5, the male zipper part 13*a* and the female zipper part 13*b* may be attached to both inner surfaces of the envelope 11, respectively.

In this case, the first and second inner opening parts 12*a* and 12*b*, which extend to the opening part, are formed at the tip of the male zipper part 13*a* and the tip of the female zipper part 13*b*, respectively.

The first and second inner opening parts 12*a* and 12*b* are not attached to the inner surfaces of the envelope 11. Only the second horizontal blade portion 133*a* of the male zipper part 13*a* or a part thereof and the second horizontal blade portion 133*b* of the female zipper part 13*b* or a part thereof are attached to the inner surfaces of the envelope 11.

According to the second exemplary embodiment of the present invention, the force is not applied directly to the protrusion portion 132*a* and the groove portion 132*b*, but the force is primarily applied to the second horizontal blade portions 133*a* and 133*b* that abut the envelope 11, such that the zipper 13 is not easily unlocked. When the force is applied while the first and second inner opening parts 12*a* and 12*b* positioned inside the zipper bag are pulled outward toward both sides, the force is applied directly to the protrusion portion 132*a* and the groove portion 132*b*, such that the zipper bag is easily opened. That is, this is because the protrusion portion 132*a* and the groove portion 132*b* are connected directly to the inner opening parts 12*a* and 12*b*.

FIG. 6 is a cross-sectional view taken along line A-A in FIG. 1 according to a third exemplary embodiment.

According to the third exemplary embodiment of the present invention illustrated in FIG. 6, the male zipper part 13*a* and the female zipper part 13*b* may be attached to both inner surfaces of the envelope 11, respectively.

In this case, the first and second inner opening parts 12*a* and 12*b*, which extend to the opening part, are formed at the tip of the male zipper part 13*a* and the tip of the female zipper part 13*b*, respectively.

The first and second inner opening parts 12*a* and 12*b* are not attached to the inner surfaces of the envelope 11. Only the first horizontal blade portion 133*a* of the male zipper part 13*a* or a part thereof is attached to the inner surface of the envelope 11, and the first horizontal extension portion 131*b*, the groove portion 132*b*, and the second horizontal extension portion 133*b* of the female zipper part 13*b* and the protrusion portion 132*a* and the second horizontal extension portion 133*a* of the male zipper part 13*a* are not attached to the inner surfaces of the envelope 11.

According to the third exemplary embodiment of the present invention, the force is not applied directly to the protrusion portion 132*a* and the groove portion 132*b*, but the force is primarily applied to the first horizontal blade portion 131*a* that abuts the envelope 11, such that the zipper 13 is not easily unlocked. When the force is applied while the first and second inner opening parts 12*a* and 12*b* positioned inside the zipper bag are pulled outward toward both sides, the force is applied directly to the protrusion portion 132*a* and the groove portion 132*b*, such that the zipper bag is easily opened. That is, this is because the protrusion portion 132*a* and the groove portion 132*b* are connected directly to the inner opening parts 12*a* and 12*b*.

The first to third exemplary embodiments of the present invention are just preferred examples. Although not illustrated, another example in which the upper or lower portions (the first horizontal extension portions 131*a* and 131*b* or the second horizontal extension portions 133*a* and 133*b*) of at least one of the male zipper part 13*a* and the female zipper part 13*b*, which are spaced apart from the portions (the protrusion portion 132*a* and the groove portion 132*b*) where the male zipper part 13*a* and the female zipper part 13*b* are coupled by male/female engagement, are attached to the inner surfaces of the envelope is also included in the scope of the present invention for achieving the object of the present invention.

FIG. 7 is a view for explaining a portion for receiving force and a mechanism for dispersing force according to the first exemplary embodiment of the present invention.

An example in which force is applied or dispersed based on the first exemplary embodiment of the present invention will be described again with reference to FIG. 7.

The safeguard zipper bag according to the present invention is configured such that the first and second outer opening parts 11*a* and 11*b* positioned outside primarily are exposed, and the first and second inner opening parts 12*a* and 12*b* are disposed inside the first and second outer opening parts 11*a* and 11*b*.

When a child or an infant intends to open the zipper bag by pulling only the first and second outer opening parts 11*a* and 11*b*, which are visible from the outside, outward toward both sides, the child or the infant pulls the first and second outer opening parts 11*a* and 11*b* in a direction P1 toward both sides, such that force is primarily applied to the portions abutting the first and second outer opening parts 11*a* and 11*b* (point F1).

The protrusion portion 132*a* receives the force because the protrusion portion 132*a* is attached to the inner surface of the envelope 11. However, the groove portion 132*b* cannot receive the force because the groove portion 132*b* is not attached to the inner surface of the envelope 11, and the force is primarily applied to the second horizontal extension portion 133*b* attached to the inner surface of the envelope 11 (point F1).

When pulling outward, toward both sides, the first and second inner opening parts 12*a* and 12*b* disposed inside the envelope (direction P2), the force is applied directly to the protrusion portion 132*a* and the groove portion 132*b* which are attached to the first and second inner opening parts 12*a* and 12*b*, such that the zipper may be easily unlocked.

With these shapes and structures, the zipper bag is generally difficult to open by the outer opening parts and easy to open by the inner opening parts, such that the safety of the zipper bag is improved, which particularly prevents a child or an infant from easily opening the zipper bag. Therefore, the zipper bag may be usefully used when the child or the infant should not touch the contents.

FIG. 8 is a cross-sectional view of a safeguard zipper bag according to another exemplary embodiment of the present invention.

The exemplary embodiment of the present invention illustrated in FIG. 8 is an example in which a dual cover is added to the same configuration and structure according to the exemplary embodiments of the present invention illustrated in FIGS. 1 to 7.

The exemplary embodiment of the present invention illustrated in FIG. 8 includes an envelope 21, first and second outer opening parts 21*a* and 21*b*, first and second inner opening parts 22*a* and 22*b*, a zipper 23, a male zipper part 23*a*, a female zipper part 23*b*, first horizontal extension portions 231*a* and 231*b*, a protrusion portion 232*a*, a groove portion 232*b*, and second horizontal extension portions 233*a* and 233*b*, and may further include a dual cover 24.

The dual cover 24 may extend from the first outer opening part 21*a* of the envelope 21, may be bent in an opposite direction from a tip portion of the first outer opening part 21*a*, and may be positioned to be folded to the inside of the envelope 21. Alternatively, the dual cover 24 may be extend from the second outer opening part 21*b*.

The dual cover 24 serves to hide the first and second inner opening parts 22*a* and 22*b* once more, and a tip of the dual cover 24 may have a length sufficient to cover the first and second inner opening parts 22*a* and 22*b*.

While the present invention has been described in detail above with reference to the limited exemplary embodiments and the drawings, the present invention is not limited thereto, and various alterations and modifications may be made by those skilled in the art to which the present invention pertains within the technical spirit of the present invention and within the scope equivalent to the appended claims.

However, it is apparent that the simple alterations and modifications cannot deviate from the scope of the present invention.

The invention claimed is:

1. A safeguard zipper bag comprising:

an envelope in the form of a bag comprising a first sheet and a second sheet that are joined at three sides to define a cavity, a top end of the first sheet being unattached to a top end of the second sheet;

a male zipper part coupled to an inner surface of the first sheet, the male zipper part comprising a protrusion portion comprising a protrusion, a first horizontal extension portion extending from a first side of the protrusion portion to a distal end in a direction towards the top end of the first sheet, and a second horizontal extension portion extending from a second side of the protrusion portion in a direction away from the top end of the first sheet;

a female zipper part coupled to an inner surface of the second sheet, the female zipper part comprising a groove portion comprising a groove that detachably mates with the protrusion of the male zipper part to close the cavity, a first horizontal extension portion extending from a first side of the groove portion to a distal end in a direction towards the top end of the second sheet, and a second horizontal extension portion extending from a second side of the groove portion in a direction away from the top end of the second sheet;

a first inner opening part extending from the distal end of the first horizontal extension portion of the male zipper part in the direction towards the top end of the first sheet and being unattached to the first sheet, the first inner opening part terminating at a first free end that is located between the top end of the first sheet and the protrusion, the first inner opening part having a first length measured from the distal end of the first horizontal extension portion of the male zipper part to the first free end of the first inner opening part, the first length being greater than a second length of any portion of the male zipper part that is attached to the first sheet and located between the protrusion and the first inner opening part; and a second inner opening part extending from the distal end of the first horizontal extension portion of the female zipper part in the direction towards the top end of the second sheet and being unattached to the second sheet, the second inner opening part terminating at a second free end that is located between the top end of the second sheet and the groove, the second inner opening part having a third length measured from the distal end of the first horizontal extension part of the female zipper part to the second free end of the second inner opening part, the third length being greater than a fourth length of any portion of the female zipper part that is attached to the second sheet and located between the groove and the second inner opening part;

wherein the first and second horizontal extension portions and the protrusion portion of the male zipper part are all attached to the inner surface of the first sheet, wherein the second horizontal portion of the female zipper part is attached to the inner surface of the second sheet, and wherein the first horizontal portion and the groove portion of the female zipper part are unattached to the inner surface of the second sheet.

2. The safeguard zipper bag according to claim 1 wherein the cavity is opened by applying pulling forces onto the first and second inner opening parts in opposing directions to remove the protrusion of the male zipper part from the groove of the female zipper part.

3. The safeguard zipper bag according to claim 1 wherein the first sheet comprises a first outer opening part extending from the top end of the first sheet towards a bottom end of the first sheet and the second sheet comprises a second outer opening part extending from the top end of the second sheet towards a bottom end of the second sheet.

4. The safeguard zipper bag according to claim 1 wherein the second horizontal extension portion of the male zipper part is attached to the inner surface of the first sheet and the first horizontal extension portion and the protrusion portion of the male zipper part are unattached to the inner surface of the first sheet, and wherein the second horizontal extension portion of the female zipper part is attached to the inner surface of the second sheet and the first horizontal extension portion and the groove portion of the female zipper part are unattached to the inner surface of the second sheet.

5. A safeguard zipper bag comprising:

an envelope in the form of a bag comprising a first sheet and a second sheet that are joined at three sides to define a cavity, a top end of the first sheet being unattached to a top end of the second sheet;

a male zipper part coupled to an inner surface of the first sheet, the male zipper part comprising a protrusion portion comprising a protrusion, a first horizontal extension portion extending from a first side of the protrusion portion to a distal end in a direction towards the top end of the first sheet, and a second horizontal extension portion extending from a second side of the protrusion portion in a direction away from the top end of the first sheet;

a female zipper part coupled to an inner surface of the second sheet, the female zipper part comprising a groove portion comprising a groove that detachably mates with the protrusion of the male zipper part to close the cavity, a first horizontal extension portion extending from a first side of the groove portion to a distal end in a direction towards the top end of the second sheet, and a second horizontal extension portion extending from a second side of the groove portion in a direction away from the top end of the second sheet;

a first inner opening part extending from the distal end of the first horizontal extension portion of the male zipper part in the direction towards the top end of the first sheet and being unattached to the first sheet, the first inner opening part terminating at a first free end that is located between the top end of the first sheet and the protrusion, the first inner opening part having a first length measured from the distal end of the first horizontal extension portion of the male zipper part to the first free end of the first inner opening part, the first length being greater than a second length of any portion of the male zipper part that is attached to the first sheet and located between the protrusion and the first inner opening part;

a second inner opening part extending from the distal end of the first horizontal extension portion of the female zipper part in the direction towards the top end of the second sheet and being unattached to the second sheet, the second inner opening part terminating at a second free end that is located between the top end of the second sheet and the groove, the second inner opening part having a third length measured from the distal end of the first horizontal extension part of the female zipper part to the second free end of the second inner opening part, the third length being greater than a fourth length of any portion of the female zipper part that is attached to the second sheet and located between the groove and the second inner opening part; and wherein the first horizontal extension portion of the male zipper part is attached to the inner surface of the first sheet and the second horizontal extension portion and the protrusion portion of the male zipper part are unattached to the inner surface of the first sheet, and wherein the second horizontal extension portion of the female zipper part is attached to the inner surface of the second sheet and the first horizontal extension portion and the groove portion of the female zipper part are unattached to the inner surface of the second sheet.

* * * * *